US006999033B2

(12) United States Patent
Kordass et al.

(10) Patent No.: US 6,999,033 B2
(45) Date of Patent: Feb. 14, 2006

(54) ANTENNA ASSEMBLY WITH INJECTION-MOLDED SEAL

(75) Inventors: Joachim Kordass, Koengen (DE); Günther Blickle, Neustetten (DE); Boris Wischniowski, Stuttgart (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 10/732,922

(22) Filed: Dec. 10, 2003

(65) Prior Publication Data

US 2004/0174311 A1 Sep. 9, 2004

(30) Foreign Application Priority Data

Dec. 11, 2002 (DE) ..... 102 58 102
Mar. 18, 2003 (DE) ..... 103 11 736

(51) Int. Cl.
*H01Q 1/32* (2006.01)

(52) U.S. Cl. ..... 343/713; 343/711

(58) Field of Classification Search ..... 343/711, 343/713, 715, 702, 872, 888; 174/151, 158 R; 52/110

See application file for complete search history.

(56) References Cited

U.S. PATENT DOCUMENTS

| | | | | |
|---|---|---|---|---|
| 6,331,838 | B1 * | 12/2001 | Scott et al. | 343/715 |
| 6,486,841 | B1 * | 11/2002 | Imahigashi | 343/715 |
| 6,773,018 | B1 * | 8/2004 | Gomez | 277/628 |
| 2003/0197649 | A1 | 10/2003 | Kozlovski | 343/711 |

FOREIGN PATENT DOCUMENTS

| | | |
|---|---|---|
| DE | 295 00 961.6 | 7/1995 |
| DE | 202 12 902 | 11/2002 |
| EP | 0 632 520 | 1/1995 |
| EP | 0 862 239 | 9/1998 |
| FR | 2 575 979 | 7/1986 |
| JP | 2000252725 | 9/2000 |

* cited by examiner

*Primary Examiner*—Wilson Lee
*Assistant Examiner*—Ephrem Alemu
(74) *Attorney, Agent, or Firm*—Herbert Dubno

(57) ABSTRACT

An antenna assembly for mounting an antenna on a vehicle body, especially upon the roof of a vehicle, in which the assembly has a base body of metal with a threaded projection passing through a hole in a wall of the vehicle body. A housing of plastic encloses the antenna components mounted upon a plate-shaped portion of the base body and a seal is provided between the base body and the vehicle body and seals around the opening between the base body and the wall of the vehicle. The seal can be injection molded and molded onto the base body in the injection-molding process.

3 Claims, 4 Drawing Sheets

ANTENNA ASSEMBLY WITH INJECTION-MOLDED SEAL

FIELD OF THE INVENTION

Our present invention relates to an antenna assembly, especially for mounting on an automotive vehicle body and particularly on a roof of an automotive vehicle, with a seal preventing the penetration of moisture, water and contaminants into the interior of the vehicle, especially an injection-molded seal.

BACKGROUND OF THE INVENTION

An antenna for a motor vehicle is described in the German patent document DE 295 00 961 E1. This antenna has a base plate or base body composed of metal and which carries antenna elements, for example a strip-conductor antenna. To protect the antenna elements which can be mounted on that base plate, an antenna housing, which can be composed of a nonconductive material like, for example, a synthetic resin material, is provided on the base plate to enclose those elements.

The base plate can be a threaded pin which can be inserted into a hole in the vehicle body and which can enable the antenna assembly to be affixed on the vehicle body. The fixing means can be, for example, a nut which is threaded onto the pin or bolt and the base plate can lie parallel to a wall of the vehicle body, for example, a roof so as to abut the latter when the nut is tightened onto the bolt.

This prior system has a drawback in that water or moisture can penetrate through the opening into the interior of the vehicle body and the penetration of moisture can affect any electronic elements which are provided beneath the assembly. In the past electronic elements like amplifiers and the like have been provided below such base body. The penetration of moisture or liquid water can adversely affect electronic components to the point that signals cannot be received by the antenna. Of course the penetration of water or moisture into the interior of the vehicle has other drawbacks as well.

The problem could not be resolved with conventional antennae which utilize base bodies of metal. However, substituting base bodies of other materials has not been found to be practical since a fixed and rigid mounting of the assembly has been necessary. Leakage can cause rusting of the metal body of the vehicle where the assembly is mounted and can cause rusting or contamination of the antenna elements as well.

OBJECTS OF THE INVENTION

It is therefore the principal object of the present invention to provide an improved antenna assembly for mounting on a vehicle body, especially the roof of a vehicle, whereby these drawbacks can be avoided.

More specifically, it is an object of the invention to provide an antenna assembly which can be fixed to a wall of a vehicle body having a hole through which a threaded pin or bolt of the base plate can pass but which effectively can seal the hole and the base plate and the adjoining portions of the vehicle body in an effective manner.

SUMMARY OF THE INVENTION

These objects are attained, in accordance with the invention by providing the base body with a seal which is preferably injection molded onto the base body or, so injection molded that it can be affixed to the base body, and which is interposed between the base body and the vehicle body and can be interposed between the housing in the antenna elements and the vehicle body or the base body and which can seal the interior of the vehicle at the hole from the exterior thereof. According to a feature of the invention the seal has at last one projection extending into the base body of the antenna assembly or hugs the projection of the base body or both and comprises a planar portion which is interposed between the surface of the base body juxtaposed with the vehicle body over the entire area of that juxtaposition.

The seal can be a one-piece member that effects sealing in two directions. On the one hand, by being compressed between the plate-shaped portions of the base body and body of the vehicle, a seal can be provided around the hole through which the threaded pin or bolt extends. On the other hand, the seal may have an upwardly-directed portion which seals against a portion of the housing, e.g. an annular wall or partition. The outer housing edge may also bear directly against the seal if desired. The sealing around the hole is important since when the hole is provided in the vehicle roof, it can open directly into the passenger compartment of the vehicle.

The seal serves to prevent any contaminants, moisture or liquid water from penetrating into the interior of the vehicle and serves to prevent rusting of the margins of the hole. The seal can be compressed when the assembly is tightened onto the vehicle body and especially when the seal surrounds the projection and extends through the hole therewith. In that case the seal can be engaged by the nut directly and compressed to further reduce the possibility that contaminants or moisture may pass around the seal through the opening. The fact that the outer periphery of the seal extends circumferentially along the outer edge of the base body, ensures that contaminants or moisture will not be able to penetrate between the seal and the base body or between the seal and the vehicle while juxtaposed with the base body.

As has been noted, it is especially advantageous to provide a seal which is formed by an injection molding process so that it can be affixed at least partly on the underside of the base body by that injection-molding process. This has the advantage that in a single step the seal can be formed particularly from a synthetic resin material but also possibly from an elastomeric material and applied to the base body or bottom plate of the antenna assembly. The sealing of the opening in the vehicle roof is thereby ensured as is sealing against the threaded pin and the base body. The formation of the seal is thereby simplified and more cost effective. The area of the seal can be determined by the geometry and area of the plate of the base body juxtaposed with the vehicle wall. Furthermore the injection molding of the seal onto the base body allows the application of the seal to be automated.

As has also been noted, the seal, while generally flat and planar, can have bulged portions or beads which provide the sealing function. In that case the flat regions need not have a sealing function and may only serve to position the beads and like formations. The injection molding process can be a single component injection molding process or a multicomponent injection molding process which allows a variety of parameters to be selected at will, namely, the dimensions of the seal, the sealing material, its relationship to the vehicle surface and the base body or the like. Seals of nylon, polyethylene, polyurethane, elastomers generally and thermoplastic materials have proven to be the most desirable.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
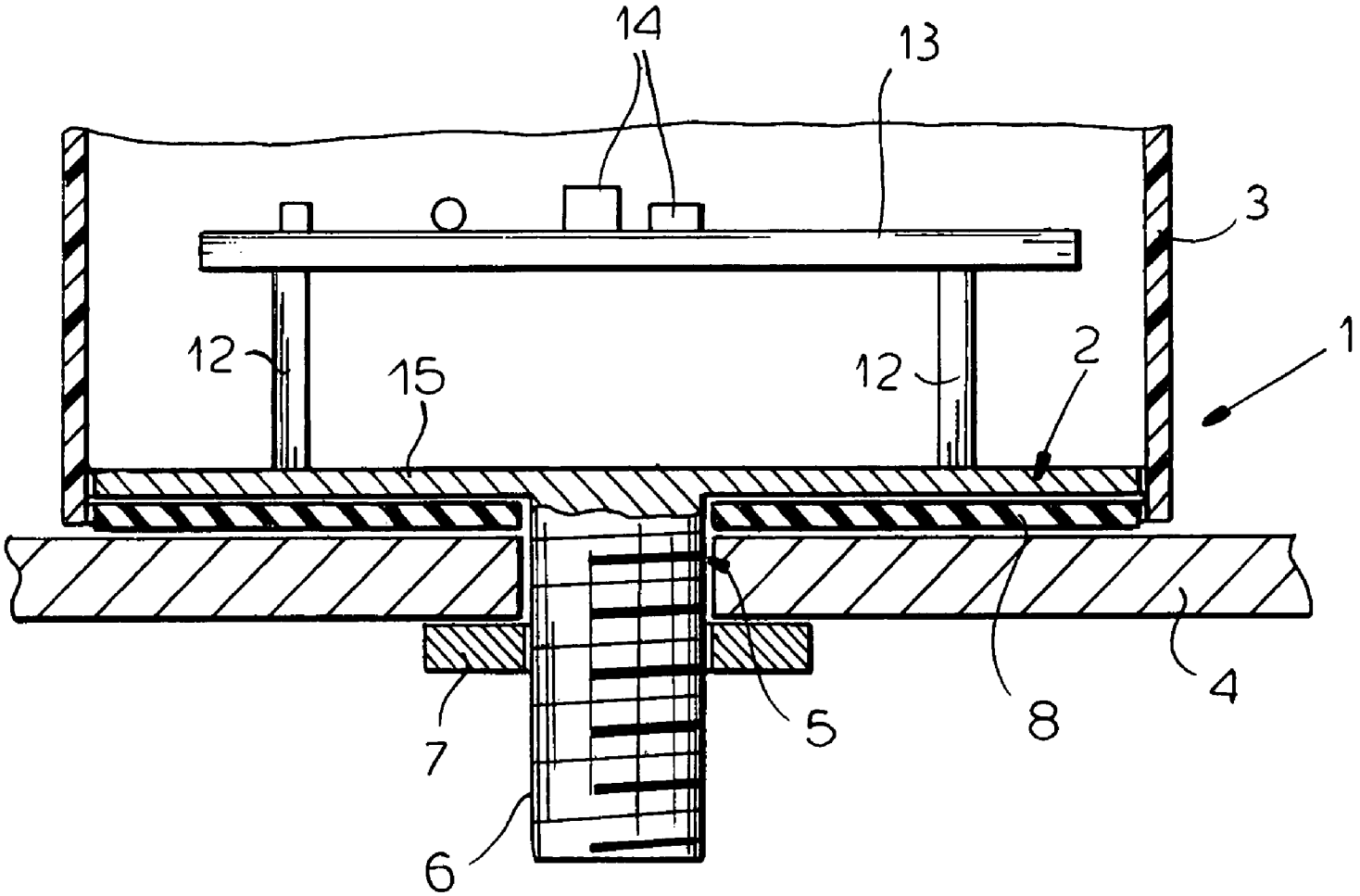
FIG. 1 is a diagrammatic cross sectional view showing a first embodiment of the invention.

The antenna 1 shown in FIG. 1 comprises a base body 2 which is comprised of metal. The base body 2 is produced by a die casting process or is formed as a stamped or punched out metal piece. Upon the base body 2 a housing 3 of a synthetic resin material is seated. The housing 3 surrounds the antenna elements optionally including electronic components such as an amplifier when the same are provided and protects them. The antenna elements will themselves vary depending upon the purpose and applications of the antenna 1. The antenna components have been shown diagrammatically at 14 and can be carried by a printed circuit board 13 mounted on posts 12 on the plate-shaped portion 15 of the base body 2 (FIG. 1).

The vehicle body wall 4 has an opening 5 which can be referred to as the vehicle body opening, in which a projection 6 with a screw thread engages. The projection 6 can be formed as an extension of the base body 2. To retain or fix the antenna 1 on the vehicle body wall 4, a nut 7 can be threaded onto the projection 6. The nut 7 can be a six-sided nut engageable by a conventional box or open end wrench.

According to the invention, parallel to the planar underside of the base body 2 and to the planar surface of the wall 4 is a planar seal 8. The seal 8 is annular and surrounds the projection 6, preferably tightly to prevent the penetration of water, moisture, dust or other contaminants through the opening 5 into the interior of the vehicle body.

It has been found to be especially advantageous to mount the seal on the underside of the base body 2 before the antenna 1 is affixed to the body and before the projection 6 is inserted through the opening 5, rather than applying the seal to the body 4 before the projection 6 is inserted. The seal simultaneously serves to seal between the housing 3 and the base body 2.

Figure 3:
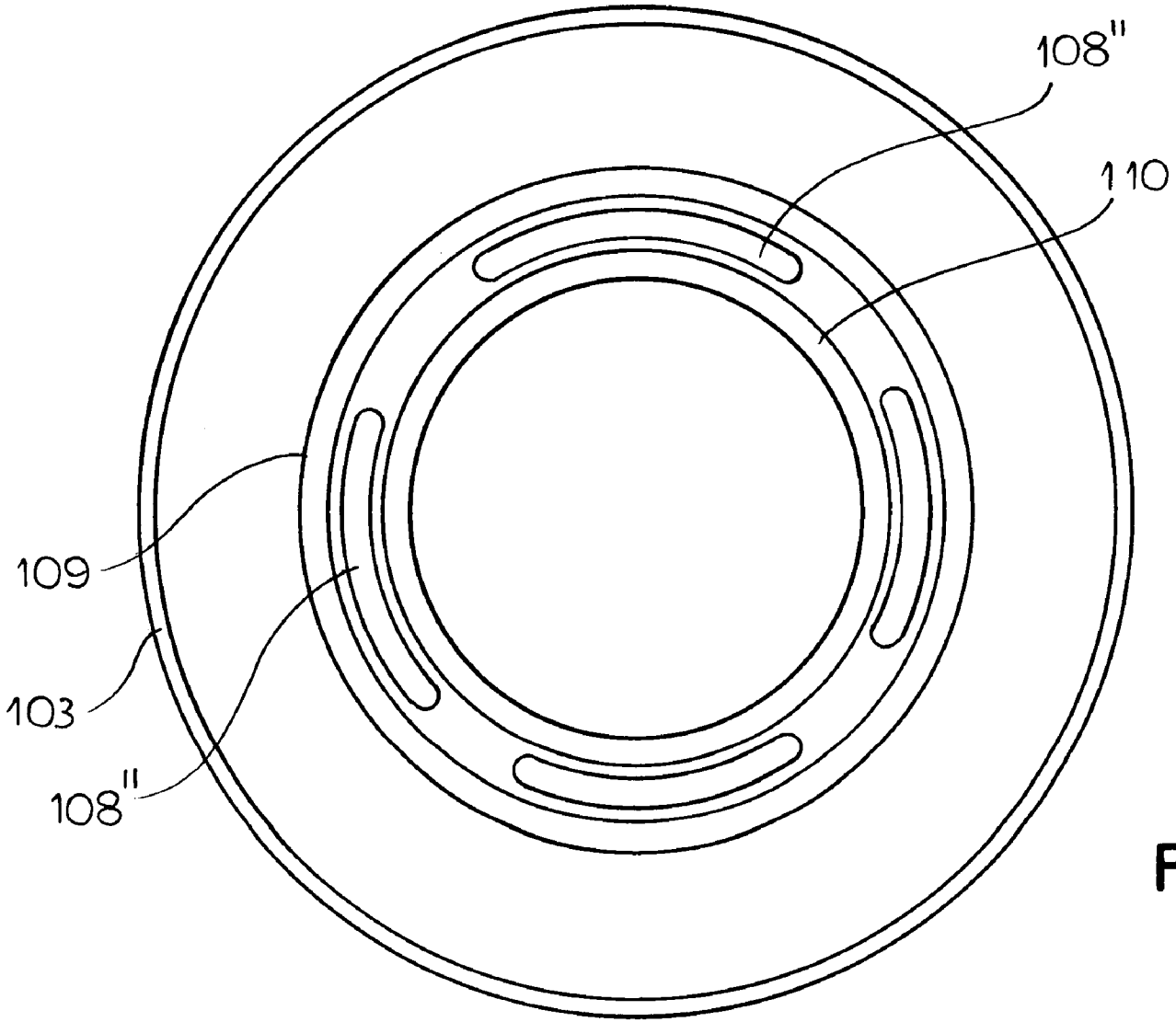
FIG. 3 is a cross sectional view taken along the line III—III of FIG. 2.

In a further embodiment illustrated in FIG. 3, the seal 208 has a sleeve-like extension 208' surrounding the projection 206 and extending into the hole 205 of the wall 204. Thus the sealing material additionally seals between the projection 206 and the opening 205. The sealing material can extend downwardly along the projection 6 to the point where it can be elastically deformed by the nut 207 directly as this nut is threaded onto the projection 206 of the base 202 in clamping the assembly to the wall 204 of the vehicle body. In this embodiment the housing has been represented at 203. In this case the nut 207 is additionally sealed by the sleeve 208' with respect to the projection 206 and the hole 205.

Figure 2:
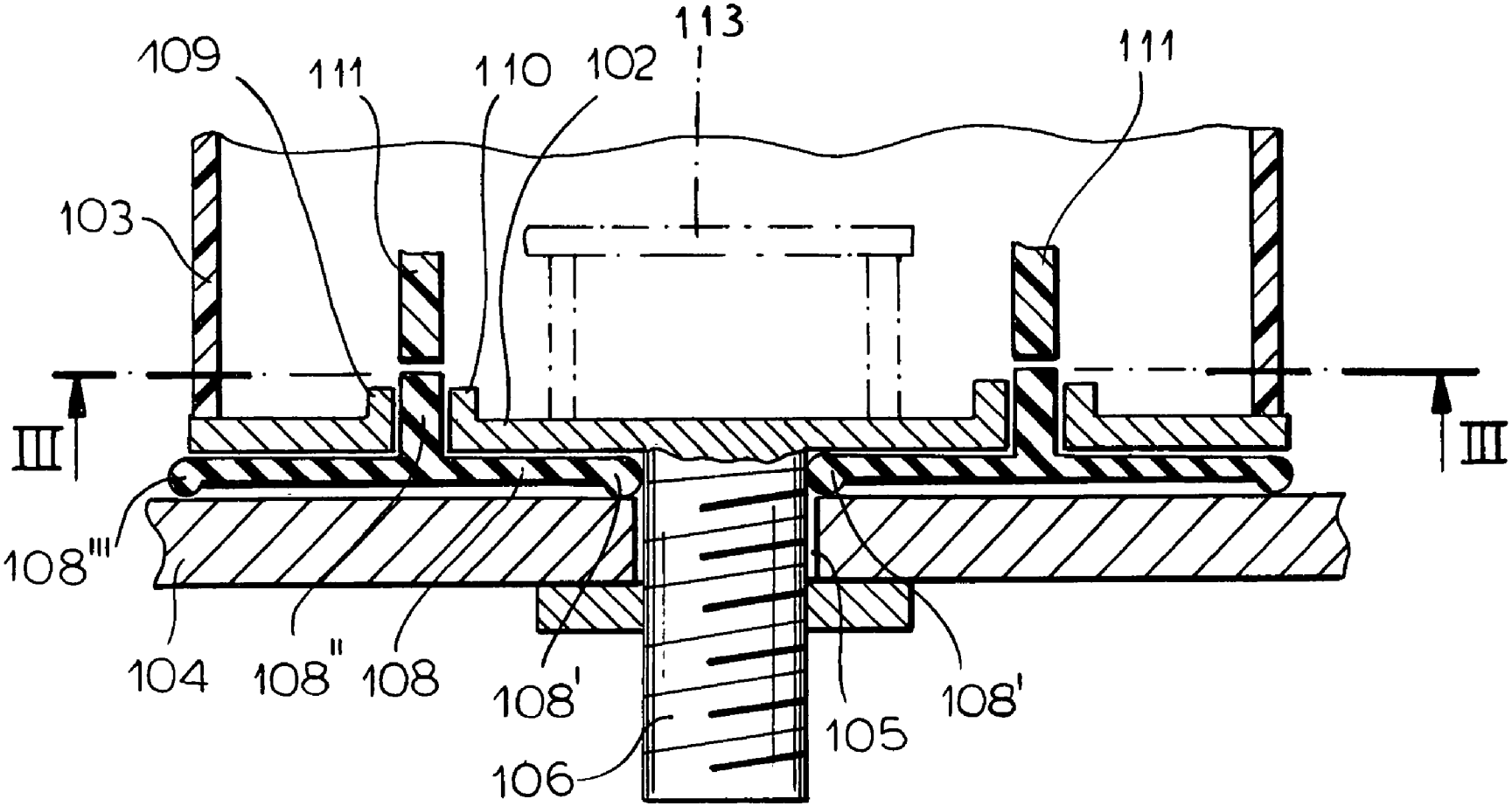
FIG. 2 is a similar view illustrating a second embodiment thereof.

FIG. 2 illustrates an embodiment of an antenna 101 which has a seal 108 between the base body 102 and the wall 104 of the vehicle body. In this case the seal 108 again seals around the projection 106, between the base body 102 and the wall 104 and between the housing 103 and the vehicle body. The seal 108 has a first portion in the form of a bead 108' which hugs the projection 106. The cross section of the bead is substantially circular. The bead provides an effective seal between the body 104 and the projection 106 immediately at the hole 104 so that no contaminant particles, moisture or liquid water can penetrate through the opening 5. The bead 108' is so positioned that it bears against the body wall 104, the base 102 and the projection 106

If desired, however, the bead 108' need not contact the projection 106. The seal 108 can have a plurality of projections 108" which can extend upwardly into openings in the base 102. In addition along the outer periphery of the seal 108 there is another circumferential bead 108''' which bears against the body 104 and prevents contaminants from penetrating between the seal and the body into the assembly. This third region 108''' of the seal is thus a so-called dust seal.

It will be apparent that, when the retention force of the base plate 102 against the body 104 is considerable with a single bead 108''' and the bead 108', the penetration of liquid water as well as moisture into the interior of the vehicle can be prevented. If the pressing force is not sufficient to prevent the penetration of moisture and liquid water into the vehicle body, additional ridges or the like can be provided to assist the sealing action. In general, the seal 108 should provide at least a dust-excluding seal.

To stabilize the portions 108" of the seal projecting through the base plate 102, an outer annular ridge 109 and an inner annular ridge 110 may be provided around the array of openings through which the projections 108" extend. The projections 108" serve to engage housing surfaces 111 which may lie within the housing 103 and provide further sealing for any antenna elements or electronic components within the space surrounded by the wall 111.

Between the surfaces of the housing 3 and the inner surfaces of the housing portions 111 and the base plate 102, there may be bayonet connections, hook connections, bolts or the like to assembly the housing 103 together with the base 102.

The configuration of the seal 108 as shown in FIG. 2 enables the seal to be fitted to the base 102 so that it will not drop out and can be easily positioned during assembly of the housing. The seal 8 can even be injection-molded onto the plate 102 if desired.

Additional openings can be provided in the plate 102, if desired, to enable the injection-molded seal 108 to be further secured to the base by the injection-molding process.

Figure 4:
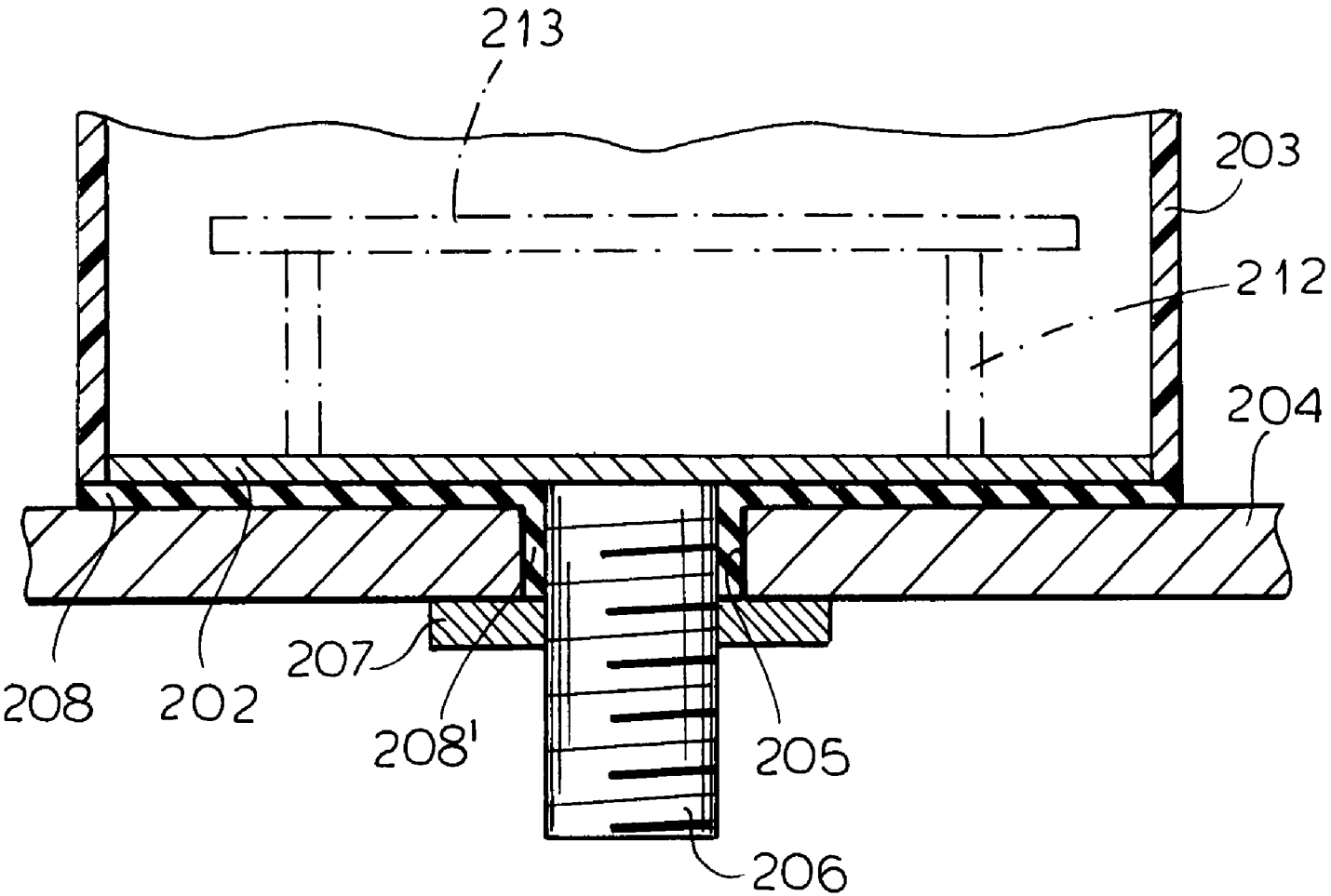
FIG. 4 is a further cross sectional view showing a modification of the embodiment of FIG. 1.

In FIGS. 2 and 4, the printed circuit boards carrying the antenna elements have been shown at 113 and 213, respectively, mounted upon posts 112 and 212, indicated in dot-dash lines.

We claim:

1. An antenna assembly for mounting upon a wall of a vehicle body, comprising:

a base plate of metal having a plate-shaped portion adapted to be juxtaposed with said wall and a threaded stud projecting from said plate-shaped portion and passing through a hole in said wall;

a housing composed of plastic and enclosing antenna elements mounted upon said base plate;

an injection-molded seal between said plate-shaped portion and one side of said wall and sealing said base plate relative to an interior of said body, said seal being formed with an outer periphery terminating at an outer edge of said base plate; and said seal having:

an inner seal bead hugging said stud and compressed between said plate-shaped portion and said wall adjacent said hole, an outer seal bead along said outer perimeter of said seal and interposed between an outer edge of said base plate and said wall, and at least one seal portion between said beads projecting through an opening in said plate-shaped portion; and a nut threaded onto said stud and braced against another side of said wall.

2. The assembly defined in claim 1 wherein said beads have generally circular cross sections.

3. The assembly defined in claim 2 wherein said base plate has ridges flanking said opening and said seal portion projecting through said opening.

* * * * *